United States Patent [19]

Baumgarte et al.

[11] 4,239,491

[45] Dec. 16, 1980

[54] DYEING AND PRINTING OF TEXTILES WITH DISPERSE DYES

[75] Inventors: Ulrich Baumgarte, Limburgerhof; Knut Oppenlaender, Ludwigshafen; Harald Schlueter, Weisenheim; Harro Petersen, Frankenthal; Norbert Greif, Bobenheim; Rainer Strickler, Heidelberg, all of Fed. Rep. of Germany

[73] Assignee: BASF Aktiengesellschaft, Fed. Rep. of Germany

[21] Appl. No.: 103,074

[22] Filed: Dec. 12, 1979

[30] Foreign Application Priority Data

Dec. 21, 1978 [DE] Fed. Rep. of Germany ..... 2855188

[51] Int. Cl.[3] ..... D06P 3/82; C09B 67/00

[52] U.S. Cl. ..... 8/532; 8/537; 8/552

[58] Field of Search ..... 8/21 C, 54.2, 88, 93

[56] References Cited

U.S. PATENT DOCUMENTS

| | | | |
|---|---|---|---|
| 3,656,880 | 4/1972 | Blackwell | 8/21 C |
| 3,706,525 | 12/1972 | Blackwell et al. | 8/21 C |
| 3,711,245 | 1/1973 | Newmer | 8/21 C |
| 3,888,624 | 6/1975 | Blackwell et al. | 8/21 C |
| 4,049,377 | 9/1977 | Schwab et al. | 8/169 |

FOREIGN PATENT DOCUMENTS 2751830 8/1978 Fed. Rep. of Germany .

*Primary Examiner*—A. Lionel Clingman
*Attorney, Agent, or Firm*—Keil & Witherspoon

[57] ABSTRACT

An improved process for dyeing or printing water-swellable cellulosic fibers and mixtures of said cellulosic fibers with synthetic fibers by contacting the fibers throughout with a dye liquor or print paste which contains, as essential ingredients, water in an amount sufficient to swell the cellulosic fibers, a water-insoluble disperse dye and a water-soluble solvent which maintains swelling of the cellulose if water is removed and which is a solvent for the disperse dye, and heating the contacted fibers to effect fixation of the dye, the improvement comprising using as water-soluble solvent a mixture of (a) polyethylene oxide, a block copolymer of ethylene oxide and propylene oxide or an ether, ester or carbamate derivative thereof and (b) a polyoxyethylated amine.

4 Claims, No Drawings

DYEING AND PRINTING OF TEXTILES WITH DISPERSE DYES

German Pat. No. 1,811,796 discloses that textiles of cellulosic fibers, or of blends of cellulosic fibers and synthetic fibers, may be dyed or printed with disperse dyes in an aqueous medium, the water-insoluble disperse dyes being introduced into the interior of the swollen cellulosic fibers by using water-soluble swelling agents and water-soluble solvents for the dye. In particular, polyethylene glycols and their derivatives are used as water-soluble swelling agents and dye solvents. In employing this process in practice, severe mist formation is encountered whilst fixing the dye, and this is attributable to the evaporated dye solvent. In dyehouses, which mostly employ equipment without special fume extraction (eg. tenter frames, cylinder-type fixing machinery, perforated drum equipment and hot flue equipment), the mist which is formed during fixation is particularly troublesome.

It is an object of the present invention to provide a process for dyeing or printing textiles of cellulosic fibers, or of blends of cellulosic fibers and synthetic fibers, with disperse dyes in an aqueous medium in the presence of water-soluble swelling agents and dye solvents, and for fixing the dyes by heating the dyed or printed textiles at up to 230° C., wherein mist formation during fixation is substantially suppressed and, furthermore, good dyeings are obtained.

We have found that this object is achieved, according to the invention, if the swelling agent and dye solvent used is a mixture of (a) from 99 to 1% by weight of one or more polyethylene glycols or one or more block copolymers of ethylene oxide and propylene oxide or their ether, ester or carbamate derivatives, and (b) from 1 to 99% by weight of one or more polyoxyethylated amines whose degree of oxyethylation is not less than 3.

The polyethylene glycols employed as component (a) in the swelling agent and dye solvent have a molecular weight of from 300 to 5,000, preferably from 400 to 1,000. Block copolymers of ethylene oxide and propylene oxide which contain from 10 to 100, preferably from 20 to 50, propylene oxide units and from 8 to 300, preferably from 10 to 200, ethylene oxide units may also be used. These block copolymers are preferably prepared by adduct formation of polypropylene glycol, comprising from 10 to 100 propylene oxide units, with from 8 to 300 moles of ethylene oxide. Products of this type may be described by the formula $$H-(O-CH_2-CH_2)_n-(O-\underset{\underset{CH_3}{|}}{CH}-CH_2)_m-(O-CH_2-CH_2)_n-OH$$

where n is from 8 to 300, preferably from 10 to 200, and m is from 10 to 100, preferably from 20 to 50.

Furthermore, monoethers and diethers of polyethylene glycols and of ethylene oxide/propylene oxide block copolymers may be used as component (a) of the swelling agent and dye solvent mixture. These compounds are prepared by reacting a monohydric or polyhydric alcohol or phenol with ethylene oxide. Examples of suitable alcohols are methanol, ethanol, propanol, butanol, hexanol, decanol and dodecanol, and polyhydric alcohols, eg. ethylene glycol, glycerol, trimethylolpropane, pentaerythritol and sorbitol. The alcohols may also be reacted with a gaseous mixture of ethylene oxide and propylene oxide. This gives monoethers of polyalkylene oxides, in which the ethylene oxide units and propylene oxide units are present in random distribution. However, polyalkylene oxide derivatives which contain ethylene oxide blocks and propylene oxide blocks may also be used. The ethers can not only be derived from alcohols, but also from phenols which are reacted with ethylene oxide or with ethylene oxide and propylene oxide. Examples of suitable phenols are unsubstituted phenol, isomeric methylphenols, bisphenol A, 2,5-dimethylphenol, 2,4-dimethylphenol, o-phenylphenol, p-chlorophenol, isooctylphenol, isononylphenol, isododecylphenol, p-tert.-butylphenol and the corresponding diisoalkylphenols.

Other suitable components (a) of the dye solvent are carboxylic acid esters of polyethylene glycols and of block copolymers of the above type. The carboxylic acid polyglycol esters are prepared, for example, by trans-esterifying an ester of, for example, a $C_2$-$C_{20}$—carboxylic acid and, for example, a $C_1$-$C_4$-alcohol, with a polyalkylene oxide. Suitable carboxylic acids may be saturated, eg. acetic acid, propionic acid, palmitic acid and stearic acid, or unsaturated, eg. acrylic acid, methacrylic acid, maleic acid and oleic acid.

Suitable carbamates are obtained, for example, by reacting urea with polyethylene oxides or with block copolymers of ethylene oxide and propylene oxide. Compounds of this type can, for example, be described by the formula $$H-(O-CH_2-CH_2)_n-(O-\underset{\underset{CH_3}{|}}{CH_3}-CH_2)_m-(O-CH_2-CH_2)_n-O-\underset{\underset{O}{\|}}{C}-NH_2$$

where n is from 8 to 300 and m is from 0 to 100.

In addition to these monocarbamates, the corresponding bis-carbamates may be used.

Not only carboxylic acid esters, but also boric acid esters—obtained, for example, by esterifying polyethylene glycol or block copolymers of ethylene oxide and propylene oxide with boric acid in the molar ratio of from 0.5:1 to 3:1—may be used. Suitable boric acid esters are also obtained by esterifying polyethylene glycol monoethers with boric acid. Such monoethers may be obtained, for example, by reacting monohydric $C_1$-$C_8$-alcohols, $C_2$-$C_8$-diols, glycerol, trimethylolpropane, pentaerythritol or sorbitol with ethylene oxide, from 1 to 20 ethylene oxide units undergoing adduct formation per hydroxyl group of the alcohol. The oxyethylation product can also be prepared using a gaseous mixture of ethylene oxide and propylene oxide, so that random copolymers are obtained. Equally, monoethers can be prepared in which propylene oxide units and ethylene oxide units are present as blocks. These monoethers are then esterified with boric acid in the conventional manner.

Polyoxyalkylated amines, having a degree of oxyalkylation of at least 3, are used as component (b) of the swelling agent and dye solvent mixture. Compounds of this type are known and are prepared, for example, by reacting amines with ethylene oxide or propylene oxide.

The amines subjected to oxyalkylation contain one or more N-H groups, or functional groups capable of oxyalkylation, for example a hydroxyethyl group, as in triethanolamine. Suitable amines contain not less than one carbon atom and not less than one basic nitrogen atom. Monoamines, diamines and polyamines may be used, for example methylamine, ethylamine, propylamine, butylamine, dimethylamine, dibutylamine, hexylamine, ethanolamine, diethanolamine, triethanolamine, piperazine, 2-ethylcyclohexylamine, dioxadodecanediamine, ethylenediamine, propylenediamine, hexamethylenediamine, neopentanediamine, diethylenetriamine, dipropylenetriamine, triethylenetetramine, tetraethylenepentamine, polyethyleneimine, aniline, N-methylaniline, naphthylamine, 3-amino-1-cyclohexylaminopropane, diamino-dicyclohexylmethane, diamino-diphenylmethane, imidazole, piperazine and polyethyleneimine.

The appropriate amines are either reacted with ethylene oxide alone, in particular with from 3 to 100, preferably from 8 to 50, moles of ethylene oxide, or are first reacted with from 3 to 100 moles of propylene oxide after which the product obtained is reacted with from 3 to 200 moles of ethylene oxide. However, it is also possible to react an amine with from 3 to 100 moles of ethylene oxide, then with from 4 to 100 moles of propylene oxide, and thereafter again with from 3 to 100 moles of ethylene oxide. This gives block polymers of the formula R-A-B-A, where A is from 3 to 100 ethylene oxide units, B is from 3 to 100 propylene oxide units, and R is the amine starting material. Block copolymers having the formula R-B-A-B can be prepared similarly. In every case, water-soluble products are obtained, which act as swelling agents for cellulose and solvents for the water-insoluble disperse dye. Preferably, the process according to the invention employs mixtures of swelling agents and dye solvents which comprise from 95 to 80% by weight of one or more compounds of type (a) and from 5 to 20% by weight of one of more compounds of type (b).

The process according to the invention is used for dyeing or printing cellulosic fibers or blends of cellulosic fibers with synthetic fibers. Cellulosic fibers are water-swellable; examples of suitable cellulosic fibers are cotton and regenerated cellulose fibers, both of which are accessible to water and to the solvent mixture. In the case of fiber blends, the synthetic fibers are in particular polyester fibers. Other suitable synthetic fibers include cellulose triacetate, secondary cellulose acetate and nylon. The proportion of synthetic fibers in the fiber mixture may vary within wide limits and may be, for example, from 80 to 20% by weight. Preferably, the process of the invention is used for dyeing or printing textile materials comprising polyester and cotton. For the purposes of the invention, the term textile materials includes slivers, webs, yarns, threads, knitted fabrics, piece goods, woven fabrics and carpets.

According to the invention, cellulosic fibers and synthetic fibers are dyed or printed with a single category of dye, namely with disperse dyes. Such disperse dyes may, for example, belong to the following categories: monoazo or polyazo dyes, anthraquinone dyes, indigoid dyes and phthalocyanine dyes. The dyes are converted to a finely disperse formulation in the presence of anionic or nonionic dispersants. The formulation may be employed as a liquid or a powder. It contains, in most cases, from 10 to 90% of pure dye.

Amongst disperse dyes, those which are insoluble in water at 100° C. or below, but are readily soluble in the solvent employed, at the fixing temperature, are particularly preferred. According to the invention, dyeing is carried out in an aqueous medium. For this purpose, the textile material is, for example, impregnated with a padding liquor which contains, per 1,000 parts of liquor, from 30 to 250 parts by weight of the swelling agent and dye solvent mixture of components (a) and (b) and from 1 to 200 parts by weight of 20% strength formulations of the disperse dyes.

Printing is carried out with print pastes which differ from the dyeing liquors in that they contain a high concentration of a thickener. Suitable thickeners are the conventionally used starch ethers, alginates, tragacanth and locust bean ethers, as well as synthetic thickeners based on high molecular weight polymers of ethylenically unsaturated carboxylic acids of 3 to 5 carbon atoms. These are, in the main, polymers of acrylic acid, methacrylic acid, maleic acid, maleic anhydride, fumaric acid and itaconic acid, and copolymers of the said carboxylic acids with one another. However, copolymers of the said carboxylic acids with other copolymerizable ethylenically unsaturated monomers, eg. ethylene, vinyl esters, acrylic acid esters, methacrylic acid esters, styrene, vinyl ethers and amides of ethylenically unsaturated $C_3$–$C_5$-carboxylic acids, may also be used. The latter group of copolymers contains not less than 40, preferably from 75 to 99.9%, by weight of ethylenically unsaturated carboxylic acids as copolymerized units. The synthetic thickeners have a high molecular weight. Particularly suitable synthetic thickeners are obtained by copolymerizing the above ethylenically unsaturated carboxylic acids with monomers which contain two ethylenically unsaturated double bonds, for example butadiene, divinylbenzene, butanediol diacrylate, divinyldioxane or diallyl phthalate. These monomers are present to the extent of from about 0.05 to 5% by weight in the structure of the high molecular weight copolymers. 1,000 parts by weight of the print paste in general contain from 10 to 80 percent by weight of a synthetic or natural thickener.

Dyeing is carried out, for example, by padding the textiles with a dyeing liquor, the wet pick-up being from 25 to 120%. After padding, the material is as a rule subjected to an intermediate drying at from 90° to 120° C., after which it is fixed at from 180° to 230° C., preferably by means of hot air at from 210° to 220° C. Fixation takes place, for example, on a tenter frame, on a hot flue or on a perforated cylinder unit, and requires from about 15 to 120, preferably from 45 to 90, seconds. Live steam at from 180° to 190° C. may also be used; in that case, the fixation time must be extended to 5–10 minutes. Fiber blends are dyed tone-on-tone. The dyed material can be rinsed cold and hot and be washed with commercial detergents. Though the fixation of the dye is carried out at a relatively high temperature, there is, surprisingly, only very slight mist formation, if any, resulting from the evaporating swelling agent and dye solvent. The fixation yield is very good and the dyeings obtained have good washfastness and fastness to crocking.

The same advantages are also achieved in printing.

The padding liquors and print pastes may additionally contain conventional additives, eg. pH regulators, antimigration agents, anti-frosting agents, emulsifiers, dispersants, leveling agents, fixation accelerators and antifoam agents. Following the fixation of the dyes, the dyed or printed textile material is rinsed and then rewashed at the boil, for which purpose conventional detergents may be used.

The Examples which follow illustrate the invention. Parts and percentages are by weight.

EXAMPLE 1

A fabric of 65 parts of polyester fibers and 35 parts of mercerized cotton is impregnated with a liquor which contains 5 g/l of a 20% strength formulation of a brown, water-insoluble disperse dye of the formula

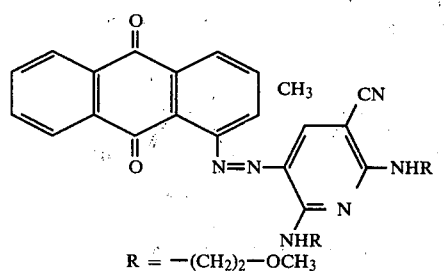

(I)

and 80 g/l of one of the swelling agents and dye solvents (1) to (13) shown below, or of a mixture of these (cf. the Table).

The following compounds served as component (a) of the swelling agent and dye solvent:

(1) Polyethylene glycol (molecular weight 600)
(2) Polyethylene glycol (molecular weight 1500)
(3) A reaction product of 1 mole of isooctylphenol with 14 moles of ethylene oxide
(4) A reaction product of 1 mole of methyl acrylate with 1 mole of polyethylene glycol (molecular weight 400) in the molar ratio 1:1

The following compounds were employed as component (b) of the swelling agent and dye solvent:

(5) A reaction product of 1 mole of butylamine and 14 moles of ethylene oxide
(6) A reaction product of 1 mole of neopentanediamine and 15.6 moles of ethylene oxide
(7) A reaction product of 1 mole of ethylenediamine and 35 moles of ethylene oxide
(8) A reaction product of 1 mole of ethylenediamine and 8 moles of propylene oxide, which was then reacted with 8 moles of ethylene oxide
(9) A reaction product of 1 mole of ethylenediamine and 16 moles of propylene oxide, which was then reacted with 16 moles of ethylene oxide
(10) A reaction product of 1 mole of hexamethylenediamine and 15 moles of ethylene oxide
(11) A reaction product of 1 mole of triethanolamine and 14 moles of ethylene oxide
(12) A reaction product of 1 mole of aniline and 10 moles of ethylene oxide
(13) A reaction product of 1 mole of piperazine and 16 moles of ethylene oxide.

The pH of the liquors was brought to 6 with glutaric acid. The wet pick-up by the fabric was 50%. The fabric samples were then dried for 60 seconds at 120° C., after which they were fixed for 60 seconds at 215° C. in a laboratory dryer. The fabric was then rinsed cold and hot and washed for 5 minutes at 100° C. in the presence of a commercial detergent.

In every case, the fabric samples were weighed, in a conditioned state, before impregnation, after intermediate drying and after the treatment at 215° C. From the values found, a percentage proportion of the solvent, applied to the fabric, which was evaporated during the heat treatment was calculated.

The Table which follows lists the volatilities of the compounds (1) to (13) and of mixtures of the compounds, in the weight ratio of 1:1, when used as swelling agents and dye solvents for the dyeing process.

TABLE

| Compound | % volatile | Product mixture | % volatile found | % volatile calculated |
|---|---|---|---|---|
| 1 | 14 | 1 + 9 | 7 | 10 |
| 2 | 14 | 2 + 9 | 6 | 10 |
| 3 | 17 | 3 + 9 | 2 | 11.5 |
| 4 | 17 | 4 + 9 | 9 | 11.5 |
| 5 | 11 | 5 + 2 | 5 | 12.5 |
| 6 | 11 | 6 + 2 | 5 | 12.5 |
| 7 | 2 | 7 + 2 | 0 | 8 |
| 8 | 8 | 8 + 2 | 2 | 11 |
| 9 | 6 | 9 + 2 | 6 | 10 |
| 10 | 15 | 10 + 2 | 6 | 14.5 |
| 11 | 7 | 11 + 2 | 2 | 10.5 |
| 12 | 5 | 12 + 2 | 0 | 9.5 |
| 13 | 9 | 13 + 2 | 3 | 11.5 |

The values calculated for the mixtures are the arithmetic mean of the volatile proportions of the two components of the mixture.

It will be seen that in every case the mixture is less volatile than was to be expected.

In every case, the mixtures give a light brown dyeing with good fastness characteristics.

EXAMPLE 2

A fabric of 65 parts of polyester fibers and 35 parts of mercerized cotton is impregnated with a liquor which contains 10 g/l of a 20% strength formulation of the red, water-insoluble disperse dye of the formula

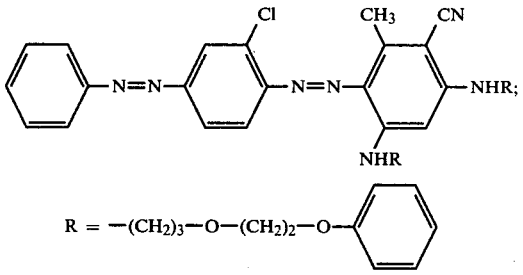

(II)

and 80 g/l of a swelling agent and dye solvent comprising a mixture of 3 parts of polyethylene glycol of molecular weight 1,500 and 1 part of a reaction product of 1 mole of neopentanediamine and 15.6 moles of ethylene oxide. The pH of the padding liquor is brought to 6 with glutaric acid. The fabric is impregnated with the padding liquor, the wet pick-up being 45%. The fabric is then dried for 60 seconds at 120° C. after which it is fixed for 90 seconds at 225° C. in a continuous laboratory dryer. It is then rinsed cold and hot and washed for 5 minutes at 100° C. in the presence of a commercial detergent. The dye is virtually completely fixed to the fabric. The red dyeing obtained has good washfastness and fastness to crocking.

A gravimetric determination shows that on fixation of the dye 3% of the solvent applied evaporates. If the ratio of polyethylene glycol to the reaction product of neopentanediamine and ethylene oxide is 15:1, 7% of the swelling agent and solvent mixture evaporate under the stated fixation conditions.

If, by contrast, the polyethylene glycol of molecular weight 1,500 is used as the sole swelling agent and dye solvent, 14% by weight evaporate under the fixation conditions. Similarly, if the reaction product of neopentanediamine with 15.6 moles of ethylene oxide is used as the sole swelling agent and dye solvent, 15% evaporate under the fixation conditions at 225° C.

EXAMPLE 3

The textile material referred to in Example 1 is impregnated with a dye liquor which contains 20 g/l of a 20% strength formulation of the dye of the formula I (Example 1) and, as the swelling agent and dye solvent, 60 g/l of a mixture of 1 part of a reaction product of 1 mole of i-octylphenol and 14 moles of ethylene oxide and 2 parts of a reaction product of 1 mole of piperazine and 16 moles of ethylene oxide. The pH of the liquor is brought to 6 with glutaric acid. The wet pick-up is 50%. The fabric is dried for 60 seconds at 120° C. and is then heated for 30 seconds at 225° C. in a continuous laboratory dryer, in order to fix the dye. The dyeing is finished as described in Example 2. A light brown dyeing having good fastness characteristics is obtained. The loss of dye on washing is very slight. The weight loss of the fabric sample after fixation is no higher than in a comparative experiment in which the liquor contains the dye formulation but no swelling agent and dye solvent.

EXAMPLE 4

The textile material referred to in Example 1 is impregnated with a dye liquor which contains 100 g/l of a 20% strength formulation of the blue dye of the formula

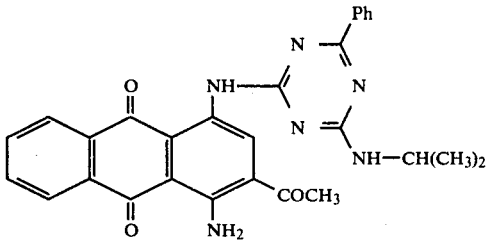

(III)

and, as swelling agent and dye solvent, 100 g/l of a mixture of 95 parts of an adduct of 1 mole of methyl acrylate and 1 mole of polyethylene glycol of molecular weight 400, and 5 parts of a reaction product of 1 mole of aniline with 10 moles of ethylene oxide. The pH of the liquor is brought to 6 with citric acid. The wet pick-up is 50%. The fabric is dried for 60 seconds at 120° C. and then heated for 90 seconds at 220° C. in a continuous laboratory dryer in order to fix the dye. The proportion of solvent which evaporates during this treatment is about 5%, which is less than when using the alkoxypropionic acid derivative alone. The dyeing is finished by the method described in Example 2. A deep blue dyeing having good lightfastness and wetfastness is obtained. The loss on washing is very slight.

EXAMPLE 5

The textile material referred to in Example 1 is impregnated with a dye liquor which contains 80 g/l of dye I (cf. Example 1) and, as swelling agent and dye solvent, 80 g/l of a mixture of 80 parts of a polyethylene glycol of molecular weight 1,500 and 20 parts of a reaction product of 1 mole of hexamethylenediamine and 15 moles of ethylene oxide. The pH of the liquor is brought to 5 with citric acid. The wet pick-up is 50%. The fabric is dried for 60 seconds at 120° C. and heated for 60 seconds at 215° C. in a laboratory dryer in order to fix the dye. The dyeing is finished as described in Example 2. A reddish brown dyeing having good washfastness, lightfastness and fastness to crocking is obtained. During fixation, there is virtually no evaporation of solvent.

EXAMPLE 6

A fabric produced from a fiber blend of 50 parts of polyester fibers and 50 parts of cotton is impregnated with an aqueous liquor which contains 20 g/l of a 20% strength formulation of the dye of the formula

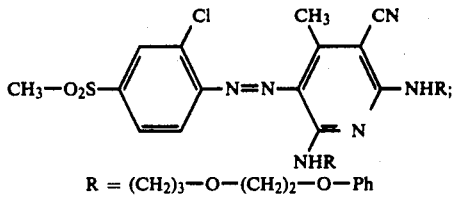

(IV)

and, as swelling agent and dye solvent, 50 g/l of a mixture of 80 parts of a polyethylene glycol of molecular weight 600 and 20 parts of a reaction product of 1 mole of triethanolamine and 14 moles of ethylene oxide. The pH of the liquor is brought to 7 with glutaric acid. The wet pick-up is 52%. The textile material is dried for 60 seconds at 120° C. and then heated for 90 seconds at 210° C. in a laboratory dryer. The dyeing is then finished as described in Example 2. A reddish yellow dyeing having good lightfastness, wetfastness and fastness to crocking is obtained, the loss on washing being very slight. The weight loss of the fabric sample after fixing is no higher than in a comparative experiment, in which the fabric is padded with a liquor which contains only the dye, but no swelling agent and dye solvent, and is then dried and fixed under identical conditions.

EXAMPLE 7

A mercerized cotton twill is impregnated with a dye liquor which contains 20 g/l of the water-insoluble dye of the formula II (cf. Example 2) and 120 g/l of a swelling agent and dye solvent mixture which comprises 90 parts of a reaction product of 1 mole of pentaerythritol and 7 moles of ethylene oxide and 10 parts of a reaction product of 1 mole of butylamine and 14 moles of ethylene oxide. The pH of the liquor is brought to 6 with glutaric acid. The wet pick-up is 53%. The fabric is dried for 60 seconds at 120° C. and then heated for 60 seconds at 200° C. in a laboratory dryer in order to fix the dye. The dyeing is finished by the method described in Example 2. A light red dyeing having good wetfastness and fastness to crocking is obtained, without substantial losses on washing. During fixation, virtually no solvent evaporates, as shown by a comparative experiment carried out in the absence of a swelling agent and dye solvent.

EXAMPLE 8

A mercerized cotton twill is impregnated with an aqueous dye liquor which contains 80 g/l of the dye (IV) (cf. Example 6) and 200 g of a mixture of 80 parts of a polyethylene glycol of molecular weight 800 and 20 parts of a block polymer of 1 mole of ethylenediamine, 8 moles of propylene oxide and 8 moles of ethylene oxide. The pH of the liquor is brought to 6 with citric acid. The wet pick-up is 52%.

The fabric is then dried at 120° C. in the conventional manner and fixed for 30 seconds at 215° C. in a laboratory dryer. During fixation, virtually no solvent evaporates. After rinsing and washing, a brilliant, intense golden orange dyeing, having good fastness characteristics, is obtained, the loss of dye being very slight.

EXAMPLE 9

A fabric of 67 parts of polyester fibers and 33 parts of mercerized cotton is impregnated with a liquor which contains 100 g/l of a mixture of 80 parts of an ester of boric acid and polyethylene glycol (molecular weight about 800) in the molar ratio of 1:3 and 20 parts of a reaction product of ethylenediamine with 35 moles of ethylene oxide. The wet pick-up is 80%. The fabric is dried for 15 minutes at 60°-70° C.

The following print paste is printed onto the fabric:

| | |
|---|---|
| 500 | parts of a 10% strength aqueous starch ether thickener |
| 2 | parts of citric acid |
| 10 | parts of sodium m-nitrobenzenesulfonate |
| 50 | parts of dye II |
| x | parts of water |
| 1,000 | parts |

After printing, the fabric is dried for 2 minutes at 130° C., treated for 90 seconds with hot air at 210° C., rinsed cold and hot, soaped hot and again rinsed cold. During the heat treatment, no solvent mist is observed.

A luminous red print on a white ground is obtained.

Example 9 is repeated, but using 50 parts of the reddish orange dye of the formula

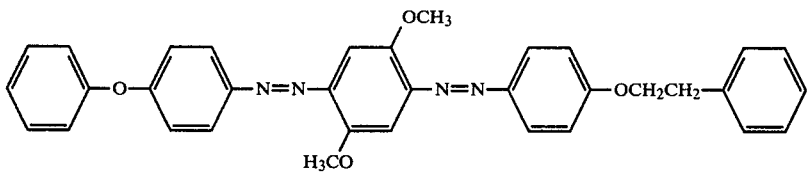

in place of the dye II. The union fabric is dyed in depth. On fixation, there is no mist formation.

EXAMPLE 10

A polyester/cotton (weight ratio 67:33) fabric is printed with the following print paste:

| | |
|---|---|
| 500 | parts of a 10% strength aqueous alginate thickener |
| 2 | parts of citric acid |
| 30 | parts of 33% strength sodium chlorate |
| 95 | parts of a polyethylene glycol of molecular weight about 600 |
| 5 | parts of a reaction product of triethanolamine with 42.5 moles of ethylene oxide |
| 50 | parts of dye IV |
| x | parts of water |
| 1,000 | parts |

After printing, the fabric is dried as described in Example 9, treated for 4 minutes with live steam at 190° C., rinsed, soaped and again rinsed.

No mist formation is observed during the heat treatment. A clear yellow print on a white ground is obtained.

The same result is obtained if instead of the dye IV 50 parts of the yellow dye of the formula

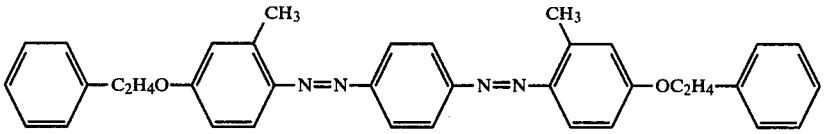

are used.

EXAMPLE 11

Example 9 is repeated, but using 50 parts of the reddish orange dye of the formula

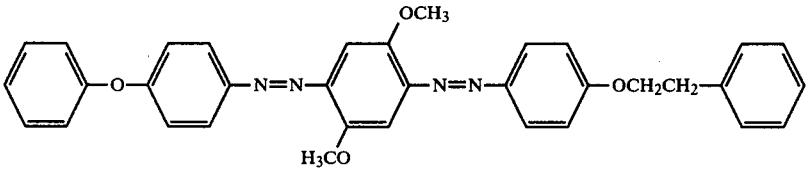

in place of the dye II. The union fabric is dyed in depth. On fixation, there is no mist formation.

EXAMPLE 12

Example 4 is repeated, except that instead of the blue dye of the formula III an equal amount of the brownish yellow dye of the formula

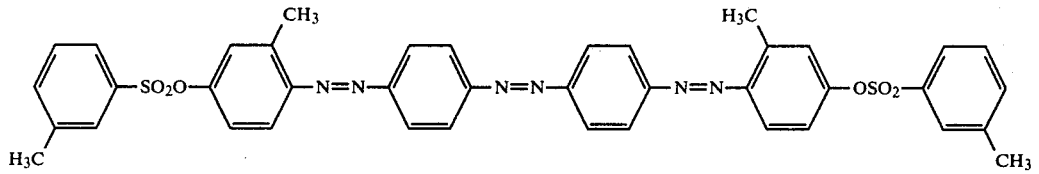

is used. In this case, again, the proportion of swelling agent and dye solvent which evaporates on fixation is about 5%.

We claim:

1. An improved process for dyeing or printing water-swellable cellulosic fibers and mixtures of said cellulosic fibers with synthetic fibers by contacting the fibers throughout with a dye liquor or print paste which contains, as essential ingredients, water in an amount sufficient to swell the cellulosic fibers, a water-insoluble disperse dye and a water-soluble solvent which maintains swelling of the cellulose if water is removed and which is a solvent for the disperse dye, and heating the contacted fibers to effect fixation of the dye, the improvement comprising using as water-soluble solvent a mixture of (a) 99 to 1% by weight of a compound selected from the group consisting of polyethylene glycol having a molecular weight of from 300 to 5,000, block copolymers of ethylene oxide and propylene oxide containing from 10 to 100 propylene oxide units and 8 to 300 ethylene oxide units, monoethers, diethers or esters of carboxylic acids of 2 to 20 carbon atoms, and mono- and biscarbamates of the said polyethylene glycol and the said block copolymers, and (b) from 1 to 99% by weight of a polyoxyalkylated amine containing at least 3 ethylene oxide units.

2. A process as claimed in claim 1, wherein the swelling agent and dye solvent is used in an amount of from 30 to 250 parts by weight per 1,000 parts by weight of the liquor or print paste.

3. A process as claimed in claim 1 or 2, wherein component (b) of the swelling agent and dye solvent is an amine oxyethylated with from 3 to 100 moles of ethylene oxide.

4. A process as claimed in claim 1 or 2, wherein component (b) of the swelling agent and dye solvent mixture is a polyoxyalkylated amine of which the polyalkylene oxide chain is composed of a block copolymer of the formula A-B-A or B-A-B, where A is a block of from 3 to 100 ethylene oxide units and B is a block of from 4 to 100 propylene oxide units.

* * * * *